United States Patent [19]

Arnone et al.

[11] Patent Number: 5,071,110

[45] Date of Patent: Dec. 10, 1991

[54] VACUUM CORRUGATION FEEDER HAVING AN AIR KNIFE WITH AN ELASTOMERIC GATE

[75] Inventors: Stephen C. Arnone, Rochester, N.Y.; Morton Silverberg, Westport, Conn.

[73] Assignee: Xerox Corporation, Stamford, Conn.

[21] Appl. No.: 131,153

[22] Filed: Dec. 10, 1987

[51] Int. Cl.[5] ..... B65H 3/34

[52] U.S. Cl. ..... 271/104; 271/11; 271/99

[58] Field of Search ..... 271/5, 3.1, 98, 99, 271/104, 11, 12

[56] References Cited

U.S. PATENT DOCUMENTS

| | | | |
|---|---|---|---|
| 3,258,262 | 6/1966 | Rehm | 271/32 |
| 4,418,905 | 12/1983 | Garavuso | 271/98 |
| 4,627,605 | 12/1986 | Roller | 271/94 |
| 4,662,625 | 5/1987 | Hoyer | 271/272 |

FOREIGN PATENT DOCUMENTS

| | | | |
|---|---|---|---|
| 0159969 | 12/1979 | Japan | 271/104 |
| 59-92842 | 5/1984 | Japan | 271/124 |
| 8200994 | 4/1982 | PCT Int'l Appl. | 271/137 |

*Primary Examiner*—H. Grant Skaggs
*Assistant Examiner*—Steven Reiss
*Attorney, Agent, or Firm*—William A. Henry, II

[57] ABSTRACT

Apparatus for feeding sheets from a stack of sheets on a sheet stack supporting tray which includes a sheet transport for feeding sheets from the tray. An air knife is disposed adjacent the front wall of the tray to inject air between the sheet to be separated and the remainder of the stack. The air knife includes at least one elastomeric member attached to its front wall that extends to a point immediately above, below or touching the sheet transport in order to inhibit multifeeding of sheets from the tray.

6 Claims, 5 Drawing Sheets

VACUUM CORRUGATION FEEDER HAVING AN AIR KNIFE WITH AN ELASTOMERIC GATE

The present invention relates to a sheet feeding apparatus and in particular to a sheet separating and feeding apparatus. A specific embodiment is directed to an air injection means for use with a bottom vacuum corrugating feeding apparatus that includes means for enhancing document restacking for high speed xerographic copy reproduction machines wherein copies can be produced at a rate in excess of three thousand copies per hour. The document handler must feed documents to the copy platen of the machine in a rapid, dependable manner in order to enable full utilization of the reproduction machine's potential copy output. A number of document handlers are currently available to fill that need. These document handlers, such as, U.S. Pat. No. 4,418,905 which is incorporated herein by reference, must operate flawlessly to virtually eliminate the risk of damaging the originals and generate minimum machine shutdowns due to uncorrectable misfeeds or document multifeeds. Problems have been encountered in recirculating document handlers with restacking A4 long edge fed (LEF) documents prematurely releasing from the vacuum restack transport resulting in their lead edges dropping and continuing under the lead edge of the air injection means. This is known as "throating" and leads to multifeed failures.

In the past, attempts at reducing multifeeding from document stacks have included the addition of fingers to the exit wall of the document holding tray as disclosed in U.S. Pat. Nos. 4,662,625 and 4,627,605 or adding hard fangs or extentions to the front wall of the air injection means. However, hard fangs have the tendency to allow a few slugs and multifeeds since about ½" must be left for tolerance between the fangs and the feed means.

Therefore, in accordance with one aspect of the present invention, the feeding and restacking of large LEF documents (A3, A4, etc.) is accomplished by a sheet feeding apparatus for feeding and restacking documents from a stack of documents including a document stack supporting tray, means to feed a document from a stack of documents, and air injection means having a front wall portion disposed adjacent an edge of said tray to inject air between the document in the stack to be separated and the remainder of the stack, said front wall of said air injection means including a plurality of elastomeric members attached thereto that extend to the document contacting surface of said means for feeding document from the stack, thereby preventing "throating" of documents being restacked in the document stack supporting tray.

For a better understanding of the invention as well further features thereof, reference is made to the following drawings and description.

DESCRIPTION OF THE INVENTION

The invention will now be described by reference to a preferred embodiment of the bottom sheet feeding apparatus.

Figure 1:
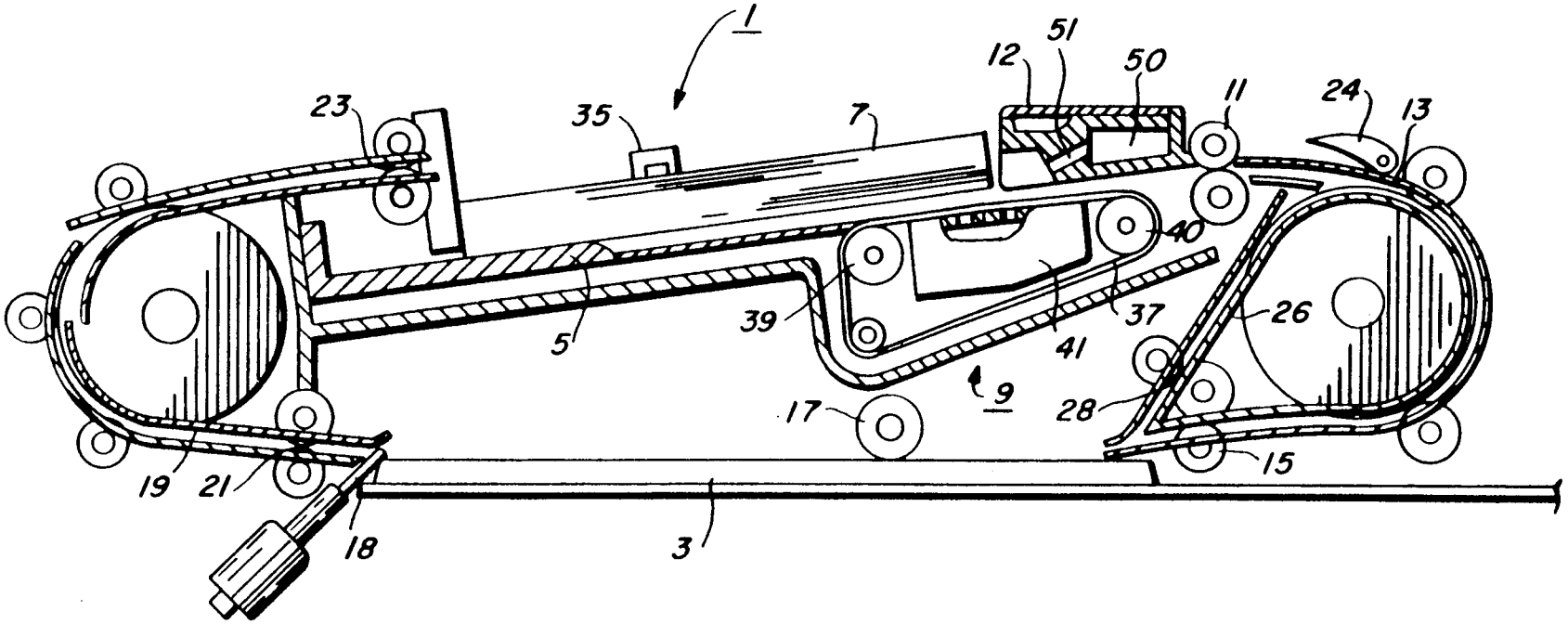
FIG. 1 is a cross sectional view of an exemplary recirculating document handler employing the elastomeric fangs of the present invention.

Referring particularly to FIG. 1, there is illustrated an exemplary automatic sheet separator feeder for installation over the exposure platen 3 of a conventional xerographic reproduction machine. This is merely one example of a document handler with which the exemplary sheet separator feeder may be combined. The document handler 1 is provided with a document tray 5 adapted for supporting a stacked set of documents 7. A vacuum belt corrugating feeder mechanism 9 is located below the front or forward area of the document tray for acquiring and corrugating the bottom document sheet in the stack and for feeding out that document sheet to take-away roll pair 11 through document guides 13 to a feed-roll pair 15 and under platen roll 17 onto the platen of the copy machine for reproduction. A retractable registration edge 18 is provided here to register the lead edge of the document fed onto the platen. Following exposure of the document, the edge 18 is retracted by suitable means such as a solenoid and that document is fed off the platen by roll 17 onto guide 19 and feed-roll pair 21 and returned back to the top of the document stack 7 through a feed-roll pair 23. Gross restacking lateral realignment is provided by an edge guide 60 (see FIG. 2) resettable to a standard sheet size distance from an opposing fixed edge guide 20. The "wing" on the guide 60 helps settle incoming (restacking) sheets between the two guides 20 and 60.

In the event it is desired to present the opposite side of a document for exposure, the document is fed from the stack 7 through guides 13 until the trail edge passes document diverter 24. Document diverter 24 is then rotated counterclockwise, i.e., into the document sheet path. The document direction is reversed and the document is diverted by diverter 24 through guides 26 and feed-roll pair 28 onto the platen 3.

The document handler 1 is also provided with a sheet separator finger 35 as is well known in the art, to sense and indicate the documents to be fed versus those documents returned to the document handler, i.e. to count each set circulated. Upon removal (feed out) of the last document from beneath sheet separator finger 35, the finger 35 drops through a slot provided in the tray 5 to actuate a suitable sensor indicating that the last document in the set has been removed from the tray. The finger 35 is then automatically rotated in a clockwise direction or otherwise lifted to again come to rest on top of all the documents in the stack 7, for the start of the next circulation of document set 7.

Figure 2:
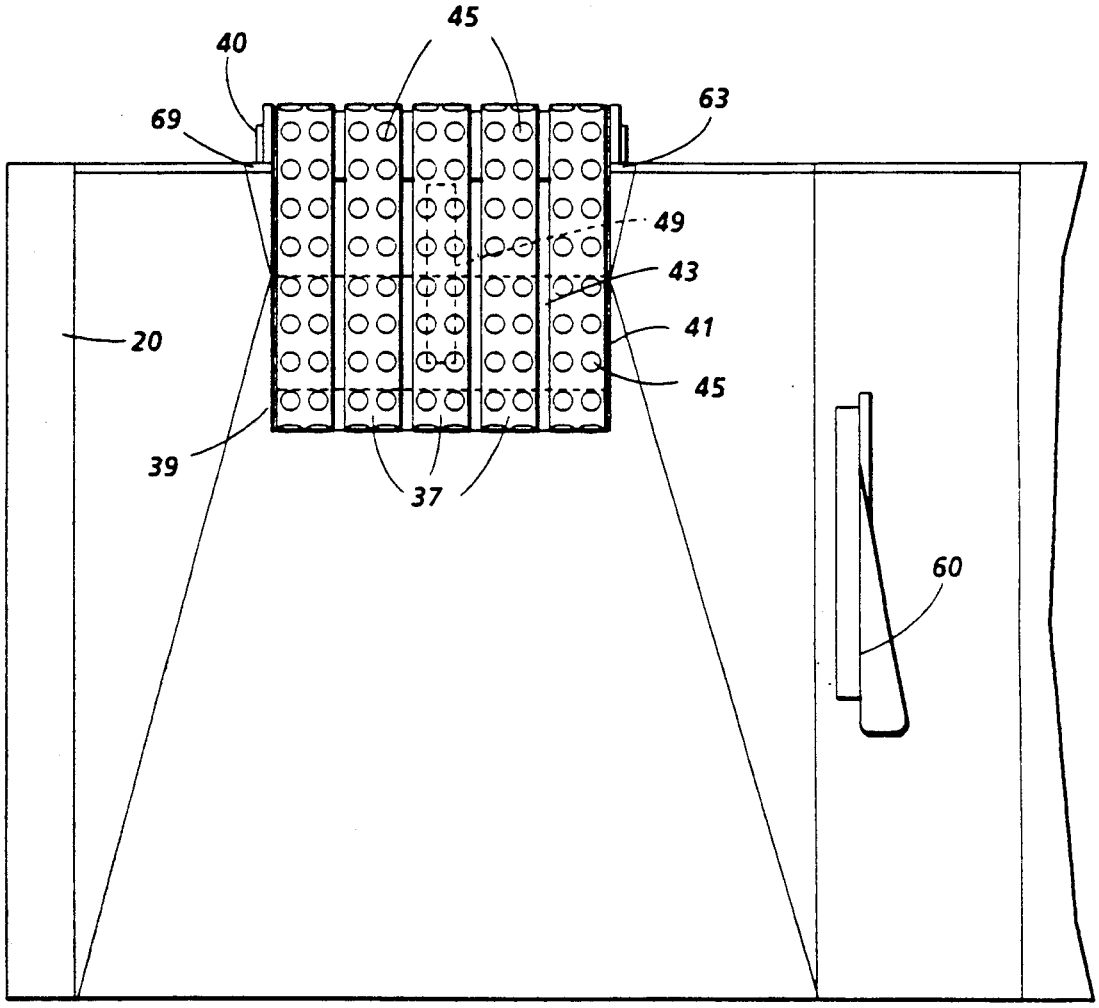
FIG. 2 is a partial plan view of the document handler of FIG. 1.
Figure 3:
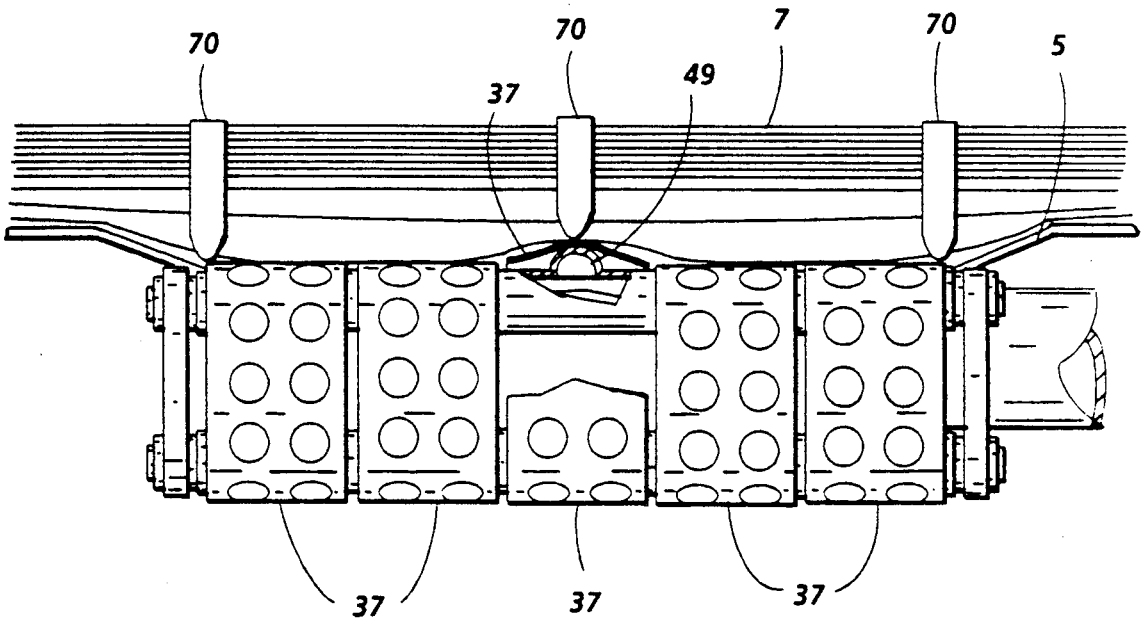
FIG. 3 is an end view partially in cross section of the vacuum feed assembly and tray of FIGS. 1 and 2 in relation to the elastomeric fangs of the present invention.

Referring more particularly to FIGS. 2 and 3 and the document sheet separator-feeder 9, a plurality of feed belts 37 are shown supported for movement on feed belt rolls 39 and 40. Spaced within the run of the belts 37 there is provided a vacuum plenum 41 having openings 43 therein adapted for cooperation with perforations 45 in the belts 37 to provide a vacuum for pulling the bottom document in the document stack onto the belts 37. The plenum 41 is provided with a raised portion 49 beneath the center belt run so that upon capture of the bottom document in the stack against belts 37, a center corrugation will be produced in the bottom sheet. This raised portion may project above the plane of the remainder of the belts by approximately 2 millimeters. Thus the document is corrugated into a double valley configuration parallel to the direction in which it is fed. The flat surfaces of the vacuum belts 37 on each side of the raised center belt generates a region of stress on the document which varies with the document beam strength. In the unlikely event that more than one document is pulled down into contact with the vacuum feed belts, the beam strength of the second (overlying) document resists this corrugating action. Thus, gaps are opened between the first and second sheets, which gaps extend to the sheet lead edges. These gaps or channels reduce the vacuum pressure levels between these sheets due to porosity in the first (bottom) sheet and provide for entry of the separating air flow from the air knife 12.

Air knife 12 injects air between the bottom most document pulled down against the feed belts and the documents in the stack thereabove to provide an air cushion or bearing between the stack and the bottom document to minimize the force needed for removing the bottom document from the stack. With the use of this air knife in conjunction with the above described bottom sheet corrugator, even if two documents are pulled down toward the belts 37, since the top sheet would not be corrugated, the air knife would inject air into the space between the two documents and force the second document off from the raised belt back toward the document stack.

Figure 4:
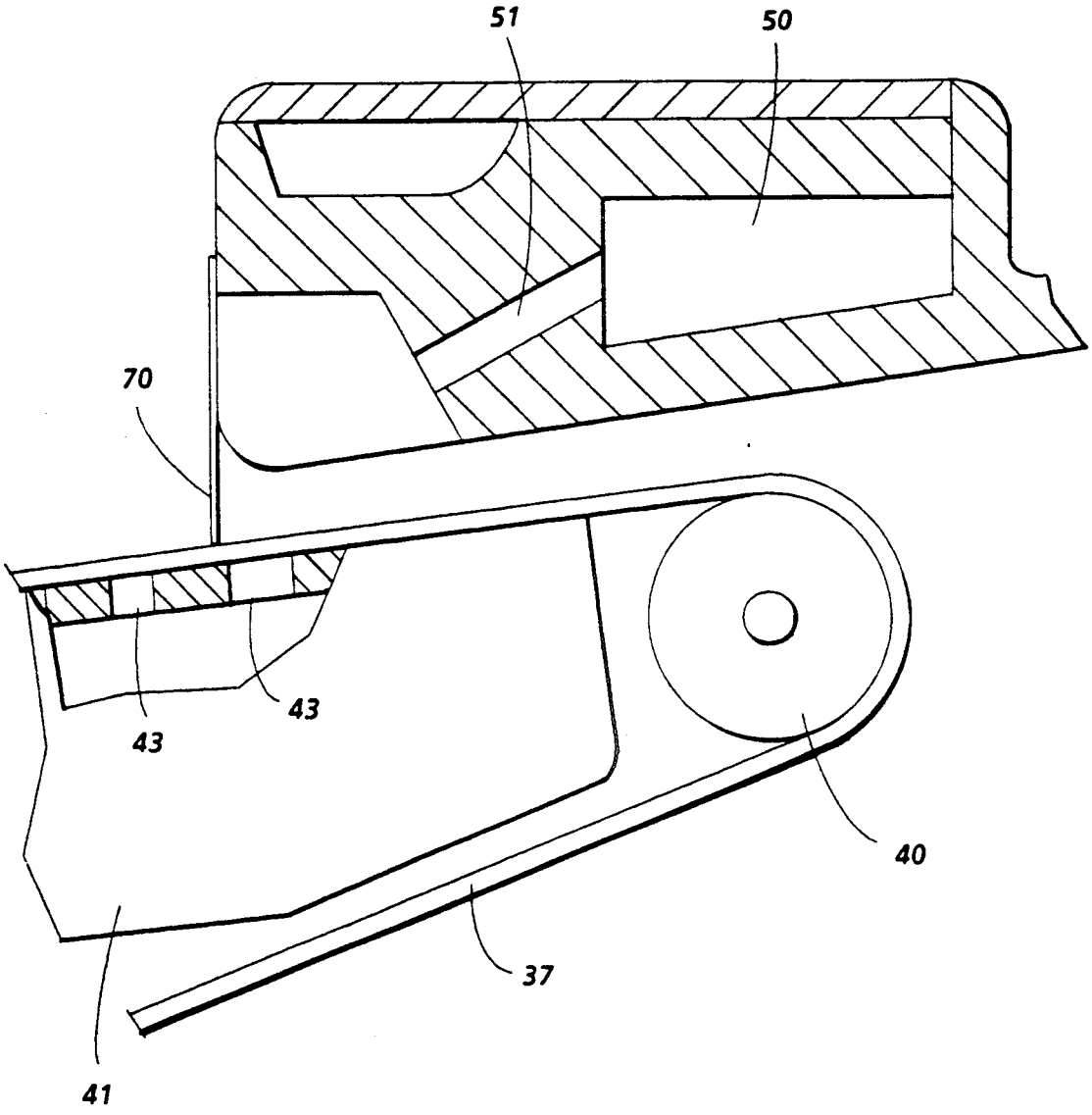
FIGS. 4 and 5 are partial schematic elevational views showing different placement positions for the elastomeric fangs shown in FIG. 3.
Figure 5:
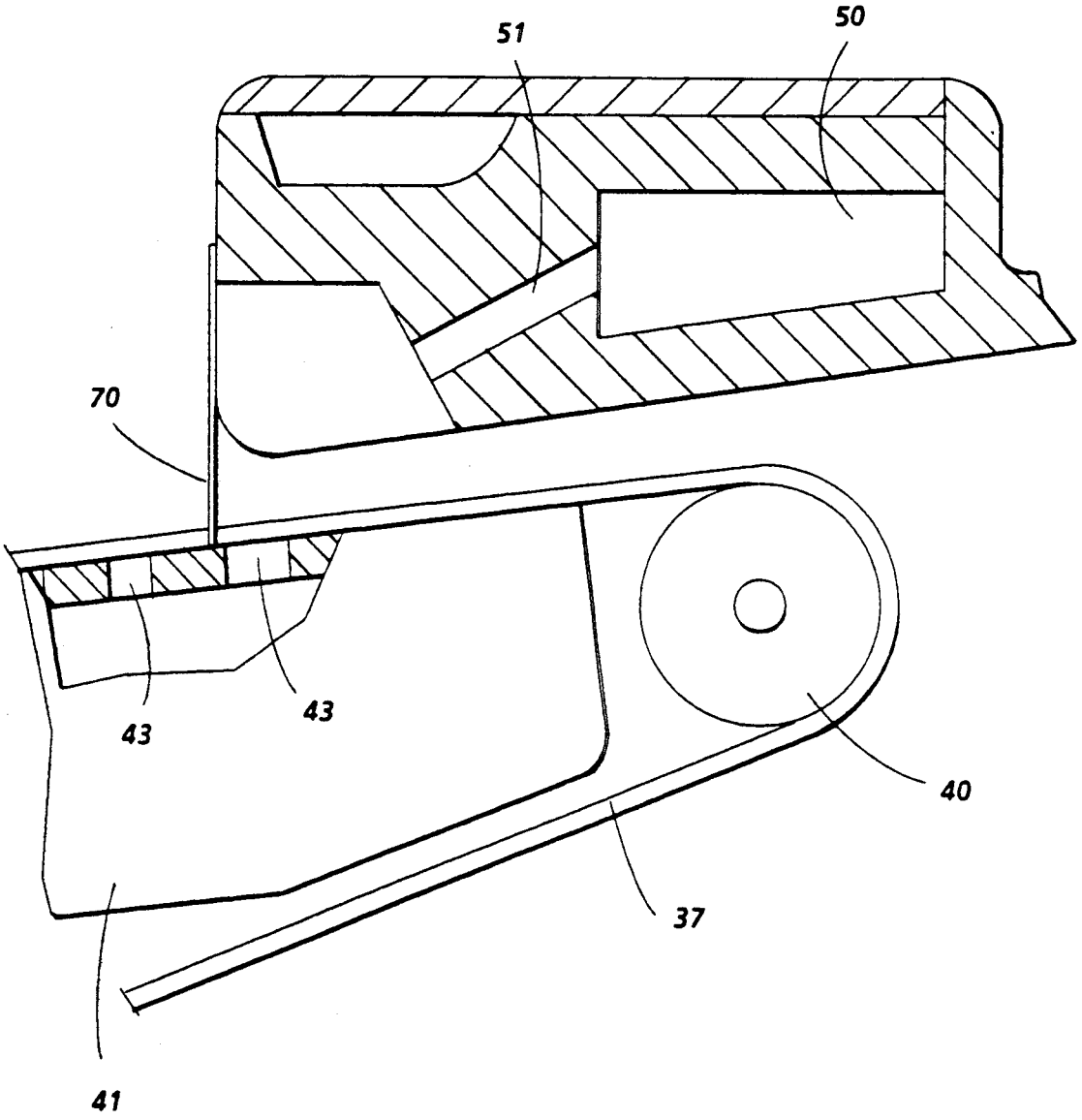

According to the present invention, and with particular reference to FIGS. 3-5, a plurality or elastomeric fangs 70 are shown attached to the front wall of air injection means 12. However, it should be understood that one or more fangs will accomplish the aims of this invention. The fangs 70 are deflectable elastomeric members which either contact the surface of vacuum belts 37, the upper surface of a "vacuum mask" over the belts or align with gaps between or alongside the belts. The fangs or fingers 70 succeed in inhibiting "throating" and unexpectedly provides the first successful implementation for adding a small friction separation component to the vacuum corrugation action of vacuum corrugation feeders. The concept of adding a friction separation component to document handlers, such as, document handler 1 had been considered prior to the present invention but discounted for fear that multiple documents would accumulate under the retard member and not respond to air knife separation. However, in fact, the flexible fangs 70 are weak enough to be pushed out of the way by light weight documents and yet provide sufficient drag on any sheet attempting to follow sheet one so as to dramatically reduce the risk of multifeeds. After the trail edge of each sheet passes the elastomeric gate or fangs 70, the gate returns to its initial position while also tending to restore any sheets stopped by it to their initial position.

An additional constraint on the use of elastomeric members 70 is the need to stiffen the lead edges of documents by vacuum corrugation. This can be accomplished in at least two locations. One is in the center of the vacuum corrugation feeder vacuum transport and the other is at either edge of the vacuum transport. The first location corresponds to the central longitudinal ridge 49 and the second location corresponds to the transition angles at tray portions 63 and 69 between the vacuum transport and tray 5 as shown in FIGS. 2 and 3.

Elastomeric members 70 are adjustable in height and can be formed from a number of materials. For example, they could be made from a copolymer of silicone rubber and urethane with a 60 durometer EDPM that is about 2 mm thick with a deflection length of 23 mm. The tips of the members are approximately in line with the top surfaces of vacuum belts 37. A further benefit of elastomeric members 70 is that air knife pressure can be reduced due to the shape of the tray 5 shown in FIG. 2 and the fangs. The elastomeric members are narrower at a point thereof adjacent the stack support tray than at a point thereof most remote from the stack support tray in order to minimize smear. The elastomeric members have arcuate end portions adjacent the means for feeding a sheet form the stack supporting tray in order to accomplish the minimizing of smear. As shown in FIGS. 4 and 5, the elastomeric members can rest on top of belts 37 or penetrate below the surfaces of the belts. The elastomeric members of the present invention are usable on both bottom and top vacuum corrugation feeders that feed both documents and copy sheets.

It should now be apparent that a simple yet significant improvement in the form of elastomeric fingers has been added to the front wall of a vacuum corrugation feeder to act as an alignment gate and prevent documents from restacking under/beyond the front of an incorporated air knife wall. The fingers also act as retard elements and aid in document separation from a stack while simultaneously further reducing multifeeds. The fingers also enables reduction of air knife pressure.

What is claimed is:

1. In a recirculating document handler apparatus adapted to separate, feed and restack documents from a stack of documents having a document stack support tray, means for feeding a document from the support tray and air injection means having a front wall positioned adjacent the front of the support tray to inject air between the document in the stack to be separated and the remainder of the stack, the improvement for preventing multifeeds when restacking large long edge fed documents being characterized by: elastomeric members positioned on the center and each side portion of said front wall of said air injection means such that incoming documents are inhibited from entering the area between said air injection means and said stack support tray.

2. The apparatus of claim 1, wherein said elastomeric members are narrower at a point thereof adjacent said stack support tray than at a point thereof most remote from said stack support tray in order to minimize smear.

3. A document feeding apparatus for feeding documents having page images thereon from a stack, comprising: a document stack supporting tray, means for feeding a document from said document stack supporting tray, and air injection means disposed adjacent an edge of said tray for injecting air between the document in the stack to be separated and the remainder of the stack, and at least one elastomeric member positioned to come into contact with the page image side of each document and adjacent said means for feeding a sheet from said document stack supporting tray and adapted to prevent multifeeding of sheets from said sheet stack, and wherein said at least one elastomeric member has an arcuate end portion adjacent said means for feeding a sheet from said stack supporting tray.

4. The apparatus of claim 3, wherein said at least one elastomeric member is a one-piece member.

5. The apparatus of claim 3, wherein said at least one elastomeric member is a composite of two separate members.

6. The apparatus of claim 3, wherein said at least one elastomeric member flexes while inhibiting multifeeding sheets from said stack supporting tray.

* * * * *